US010900375B2

(12) United States Patent
Mahalek

(10) Patent No.: US 10,900,375 B2
(45) Date of Patent: Jan. 26, 2021

(54) TURBINE WITH QUICK-CLOSING VALVES AND REGULATING VALVES

(71) Applicant: SIEMENS AKTIENGESELLSCHAFT, Munich (DE)

(72) Inventor: Michael Mahalek, Nuremberg (DE)

(73) Assignee: Siemens Aktiengesellschaft

( * ) Notice: Subject to any disclaimer, the term of this patent is extended or adjusted under 35 U.S.C. 154(b) by 136 days.

(21) Appl. No.: 15/770,232

(22) PCT Filed: Oct. 4, 2016

(86) PCT No.: PCT/EP2016/073604
§ 371 (c)(1),
(2) Date: Apr. 23, 2018

(87) PCT Pub. No.: WO2017/071912
PCT Pub. Date: May 4, 2017

(65) Prior Publication Data

US 2018/0306051 A1 Oct. 25, 2018

(30) Foreign Application Priority Data

Oct. 30, 2015 (DE) ..... 10 2015 221 311

(51) Int. Cl.
*F01D 17/14* (2006.01)
*F01D 21/00* (2006.01)

(52) U.S. Cl.
CPC ..... *F01D 17/145* (2013.01); *F01D 21/00* (2013.01); *F05D 2220/31* (2013.01); *F05D 2230/80* (2013.01); *F05D 2260/406* (2013.01)

(58) Field of Classification Search
CPC ..... F01D 17/145; F01D 21/00
See application file for complete search history.

(56) References Cited

U.S. PATENT DOCUMENTS 3,556,463 A 1/1971 Williams
4,534,702 A 8/1985 Johnson, Jr. et al.
(Continued)

FOREIGN PATENT DOCUMENTS

CH 349623 A 10/1960
DE 1946968 U 9/1966
(Continued)

OTHER PUBLICATIONS

PCT International Search Report and Written Opinion of International Searching Authority dated Dec. 1, 2017 corresponding to PCT International Application No. PCT/EP2016/073604 filed Apr. 10, 2016.

(Continued)

*Primary Examiner* — David E Sosnowski
*Assistant Examiner* — Danielle M Christensen
(74) *Attorney, Agent, or Firm* — Schmeiser, Olsen & Watts LLP

(57) ABSTRACT

Provided is a turbine having a turbine regulating unit, a turbine protection unit, at least one safety block, quick-closing valves and regulating valves, wherein the quick-closing valves and the regulating valves can be actuated by associated switching and setting drives, wherein the at least one safety block is a pneumatic safety block, and in that at least one switching drive for direct or indirect actuation of a quick-closing valve is a pneumatic switching drive. The embodiment also relates to a method for retrofitting an existing turbine having a turbine protection unit, a turbine regulating unit, a hydraulic safety clock, quick-closing valves and regulating valves, wherein the quick-closing valves can be actuated directly or indirectly by associated hydraulic switching drives.

12 Claims, 6 Drawing Sheets

(56) References Cited

U.S. PATENT DOCUMENTS

| | | | | |
|---|---|---|---|---|
| 4,589,444 | A | 5/1986 | Masek et al. | |
| 5,832,944 | A * | 11/1998 | Lindner | F01D 17/145 137/1 |
| 10,119,478 | B2 * | 11/2018 | Been | F15B 20/008 |
| 2009/0263236 | A1 | 10/2009 | Goll | |
| 2011/0146273 | A1 | 6/2011 | Gerum | |
| 2012/0114460 | A1 | 5/2012 | Cole | |
| 2014/0026747 | A1 | 1/2014 | Finke et al. | |
| 2017/0096908 | A1 * | 4/2017 | Pacelli | F15B 11/10 |

FOREIGN PATENT DOCUMENTS

| | | | |
|---|---|---|---|
| DE | 4446605 | A1 | 6/1996 |
| DE | 202011109158 | U1 | 1/2012 |
| DE | 102011116472 | A1 | 5/2012 |
| EP | 0127027 | A1 | 12/1984 |
| EP | 1026368 | A1 | 8/2000 |
| EP | 1895219 | A2 | 3/2008 |
| EP | 2110592 | A2 | 10/2009 |
| EP | 2620655 | A1 | 7/2013 |

OTHER PUBLICATIONS

European Exam Report for Application No. 16 778 768.8, dated Feb. 13, 2019.

Non-English Chinese Office Action dated Aug. 29, 2019 for Application No. 201680063440.9.

* cited by examiner

TURBINE WITH QUICK-CLOSING VALVES AND REGULATING VALVES

CROSS-REFERENCE TO RELATED APPLICATIONS

This application claims priority to PCT Application No. PCT/EP2016/073604, having a filing date of Oct. 4, 2016, based on German Application No. 10 2015 221 311.0, having a filing date of Oct. 30, 2015, the entire contents both of which are hereby incorporated by reference.

FIELD OF TECHNOLOGY

The following relates to a turbine having a turbine regulation unit, a turbine protection unit, at least one safety block, quick-closing valves and regulating valves, wherein the quick-closing valves and the regulating valves are able to be actuated via assigned switching and actuating drives. The following also relates to a method for retrofitting an existing turbine having a turbine protection unit, a turbine regulation unit, a hydraulic safety block, quick-closing valves and regulating valves, wherein the hydraulic quick-closing valves are able to be actuated via assigned hydraulic switching drives.

BACKGROUND

Turbines of the type mentioned in the introduction are known in a wide variety of configurations in the known art. The turbine regulation unit is known to perform, inter alia, functions such as power regulation, pressure regulation, rotational speed regulation, valve-position regulation, processing of measurement values, etc., to name just a few examples. The turbine protection unit detects all the process criteria which can have an adverse effect on the turbine or on the operating personnel and switches the turbine off as soon as corresponding limit values are exceeded. During operation, the quick-closing and regulating valves are responsible for the supply, regulation and blocking of the working fluid for the steam turbine. At present, the functions "open" and "close" in the case of quick-closing valves and "open", "regulate" and "close" in the case of regulating valves are primarily controlled, through the use of hydraulic switching and actuating drives, via a central hydraulic safety block and the turbine regulation unit, which for their part are integrated into the control- and regulation-oil system of the turbine.

Quick-closing valves normally work with pilot control, and for this reason valve forces which are not overly large are to be controlled. Against this background, it is also the case that the quick-closing valves do not constitute determining components in the selection of the oil systems. Generally, they can manage with low-pressure oil installations of 8 to 12 bar.

Regulating valves can in principle be subdivided into two groups, specifically into pressure-relieved valves with permeability, due to construction, and small actuating forces, such as for example relieved pipe valves without a pilot stroke, single-seat valves with a preheating bore, or double-seat valves, and into non-pressure-relieved single-seat valves; which are completely tight, with large actuating forces, such as for example thumb valves, mushroom valves, pilot-stroke valves, or pipe valves with a pilot stroke. The relieved regulating valves can generally manage with low-pressure hydraulics of 8 to 12 bar. Non-relieved regulating valves require, in dependence on the pressure of the working fluid, medium-pressure hydraulics of 30 to 50 bar or high-pressure hydraulics of 100 to 160 bar.

A significant disadvantage of turbines of the above-described type is that the control- and regulation-oil system is very costly regarding planning, acquisition, assembly, testing, putting into operation and maintenance. Furthermore, in the event of oil leakage, in particular at the hot front end of the turbine, there is a high risk of fire, this being associated with a corresponding risk potential for the turbine itself and the operating personnel.

SUMMARY

An aspect relates to a turbine of the type mentioned in the introduction with an alternative construction, which at least partly eliminates the above-described problems.

In order to achieve this aspect, embodiments of the present invention provide a turbine of the type mentioned in the introduction, which is characterized in that the at least one safety block is a pneumatic safety block, and in that at least one switching drive for directly or indirectly actuating a quick-closing valve is a pneumatic switching drive. "Direct actuation" is to be understood here to mean that the pneumatic switching drive acts directly on the valve spindle of the quick-closing valve. In the case of indirect actuation, the pneumatic switching drive may form for example a constituent part of a control device of a medium-actuated quick-closing valve. The use of a pneumatic switching drive instead of a hydraulic switching drive for the switching of a quick-closing valve which is arranged for example in the region of the hot front end of the turbine allows the risk of fire to be significantly reduced. Consequently, a high level of safety is achieved for the turbine itself and the operating personnel. Furthermore, the costs of insurance can be reduced. A further advantage is that, in comparison with hydraulic switching drives, pneumatic switching drives constitute a simple, robust and low-cost alternative. Furthermore, pneumatic switching drives are very reliable, exhibit only low wear and are able to be integrated into the turbine protection unit without any problems. Correspondingly, low costs are associated with the use of pneumatic switching drives.

According to one configuration of embodiments of the present invention, all the switching drives for actuating the quick-closing valves are pneumatic switching drives. In this way, optimum use is made of the above-described advantages.

Preferably, the turbine protection unit and the at least one pneumatic safety block are designed and configured such that, via these, the control of the pneumatic switching drive or of the pneumatic switching drives is realized. In other words, the control of the pneumatic switching drives is simply integrated into the existing turbine protection unit, this likewise leading to a low-cost construction.

The pneumatic safety block advantageously has a plurality of 5/2 directional valves connected in series, in particular three 5/2 directional valves in a 2-of-3 circuit. In the case of such a construction of the pneumatic safety block, the functions "open", "close", "vent" and "test" can be realized without any problems. The significant advantage which is associated with three 5/2 directional valves connected in series is that reliable operation of the turbine is possible even if one of the directional valves should fail. Correspondingly, downtimes of the turbine in the event of a failure of one of the directional valves are avoided. In principle, it is of course also possible to use 3/2 directional valves.

According to one configuration of embodiments of the present invention, electrical actuating drives and/or hydraulic actuating drives with autonomous oil supply, which are in particular operated with a liquid of low flammability, are provided for actuating the regulating valves. Electrical actuating drives can be used instead of hydraulic actuating drives in particular if the regulating valves to be actuated are relieved regulating valves. By contrast, use is made of hydraulic actuating drives with autonomous oil supply in particular in the case of non-pressure-relieved regulating valves. If all the regulating valves are replaced by electrical actuating drives and/or by hydraulic actuating drives with autonomous oil supply, it is possible to dispense entirely with a central control- and regulating-oil system, this being associated with a considerable cost saving. Just the lubricating oil system, which is normally operated at approximately 2 (two) bar, would then remain. If the hydraulic actuating drives with autonomous oil supply are operated with a liquid of low flammability, then the risk of fire is moreover reduced to a minimum.

In order to achieve the above-mentioned object, embodiments of the present invention also propose a method for retrofitting an existing turbine having a turbine protection unit, a turbine regulation unit, a hydraulic safety block, quick-closing valves and regulating valves, wherein the quick-closing valves are able to be actuated directly or indirectly via assigned hydraulic switching drives. The retrofitting method according to embodiments of the invention is characterized in that at least one hydraulic switching drive of a quick-closing valve is replaced by a pneumatic switching drive, and in that a pneumatic safety block which at least partially replaces the functions of the hydraulic safety block is provided.

It is also preferable in the method according to embodiments of the invention for all the hydraulic switching drives to be replaced by pneumatic switching drives, this being associated with the above-described advantages.

The control is advantageously modified such that the at least one pneumatic switching drive is controlled via the turbine protection unit and the pneumatic safety block, this being associated with a very simple and low-cost construction.

According to one configuration of the method according to embodiments of the invention, at least one hydraulic actuating drive is replaced by an electrical actuating drive.

According to a further configuration of embodiments of the invention, additionally or alternatively, at least one hydraulic actuating drive, which is connected to a central control- and regulation-oil system of the turbine, is replaced by a hydraulic actuating drive with autonomous oil supply.

The turbine regulation unit is advantageously modified such that the at least one electrical actuating drive and/or the at least one hydraulic actuating drive with autonomous oil supply are/is controlled via the turbine protection unit and the turbine regulation unit.

BRIEF DESCRIPTION

Some of the embodiments will be described in detail, with references to the following Figures, wherein like designations denote like members, wherein.

DETAILED DESCRIPTION

Figure 1:
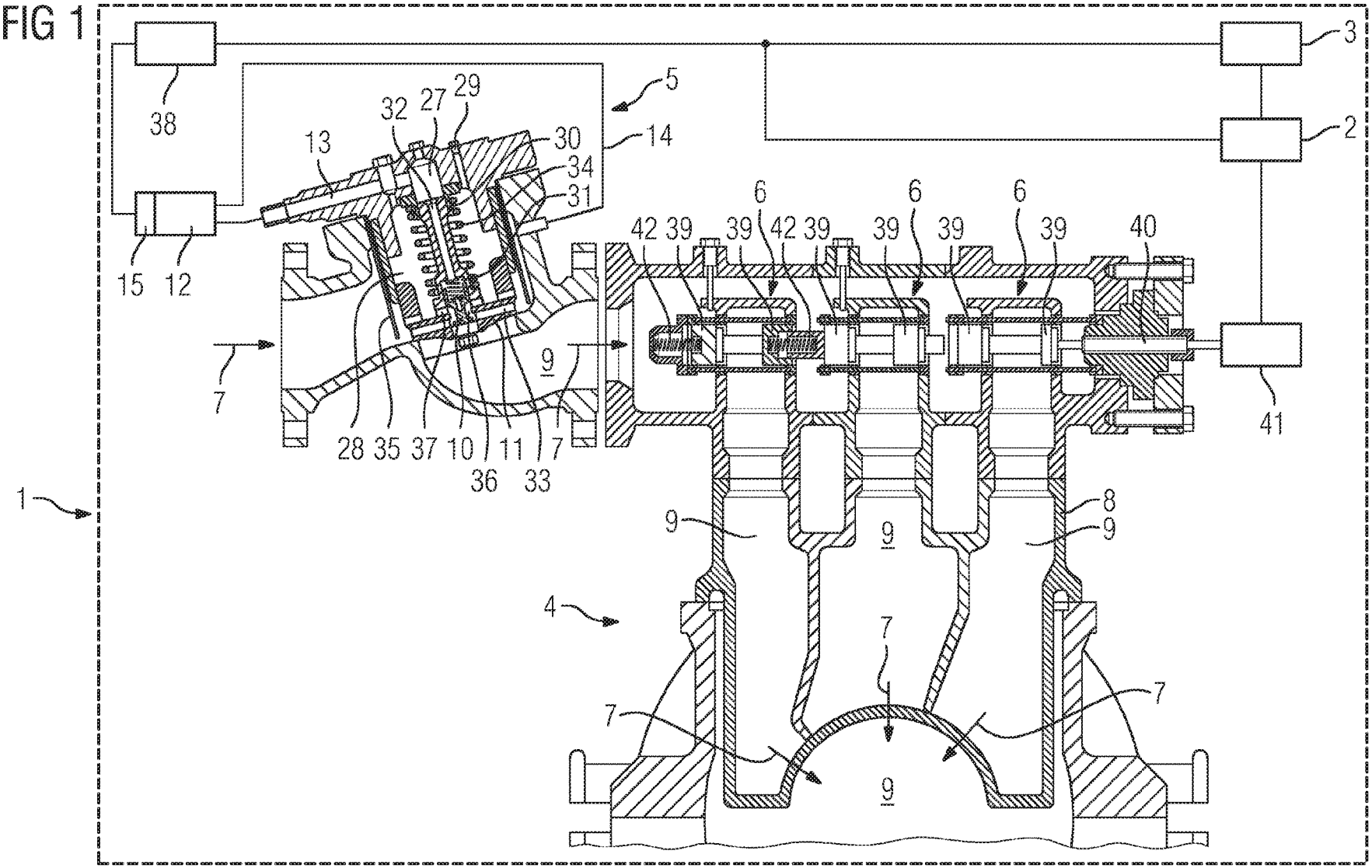
FIG. 1 is a schematic view of a high-pressure valve group of a turbine according to an embodiment of the present invention.
Figure 2:
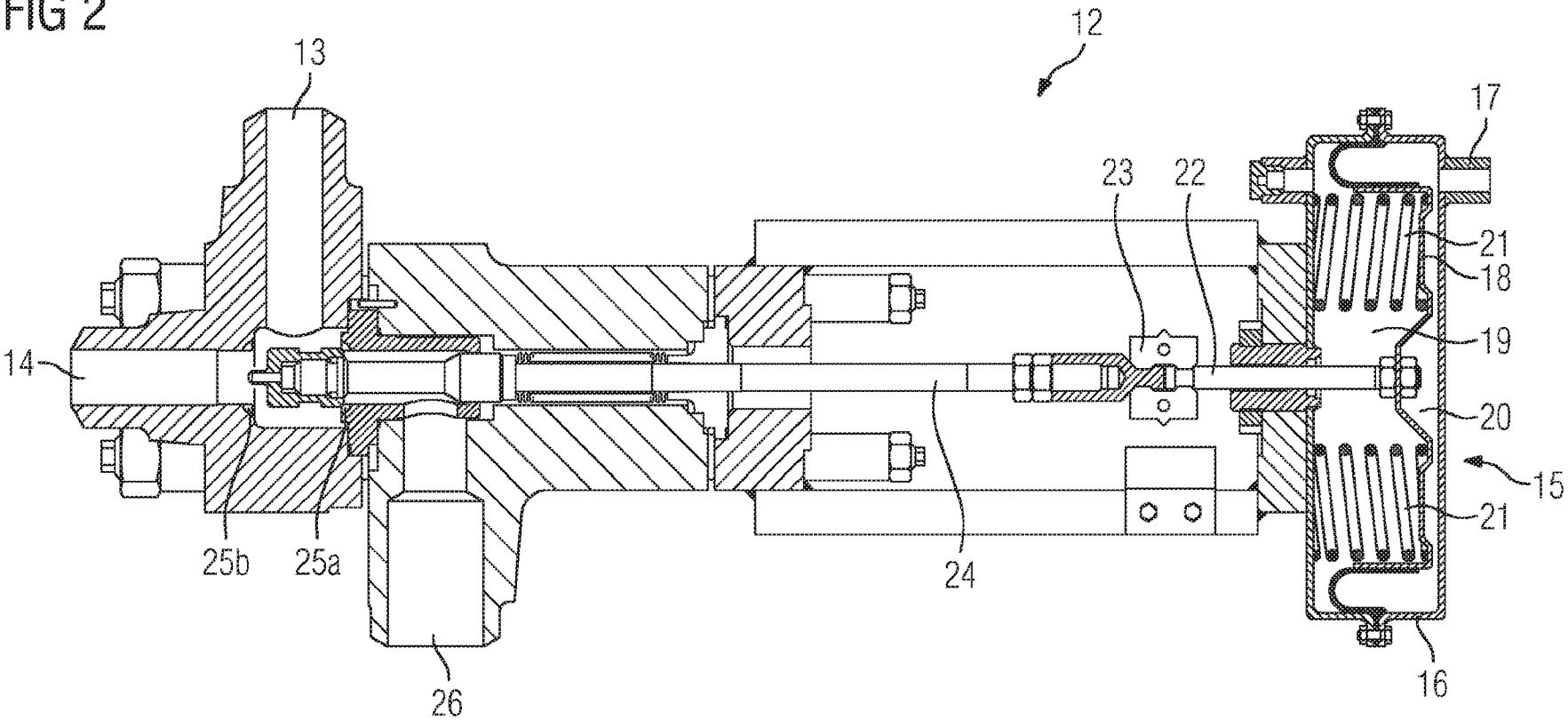
FIG. 2 is a schematic view, which shows a control device of a medium-actuated quick-closing valve of the high-pressure valve group illustrated in FIG. 1.

FIG. 1 schematically shows a turbine 1, which in the present case is a steam turbine. The turbine 1 comprises a turbine regulation unit 2 and a turbine protection unit 3 in a known manner. The turbine regulation unit 2 performs, inter alia, functions such as power regulation, pressure regulation, rotational speed regulation, valve-position regulation, processing of measurement values, etc., to name just a few examples. The turbine protection unit 3 detects all the process criteria which can have an adverse effect on the turbine 1 or on the operating personnel and switches the turbine 1 off as soon as corresponding limit values are exceeded. The turbine 1 has a series of valve groups, of which FIG. 1 illustrates a high-pressure valve group 4 by way of example. In the present case, the high-pressure valve group 4 comprises a quick-closing valve 5 and three regulating valves 6, which are responsible for the supply, regulation and blocking of the fresh steam which flows in the direction of the arrows 7 through a fresh steam path 9, formed inside a housing 8, in the direction of the high-pressure stage during the operation of the turbine. The quick-closing valve is in the present case a medium-actuated quick-closing valve whose pilot-control cone 10 and main cone 11 are moved via the fresh steam into the positions "open" or "closed" in dependence on the switching position of a control device 12. Provided for this purpose are control lines 13 and 14 which connect the quick-closing valve 5 to the control device 12. The control device 12 comprises a pneumatic switching drive 15, which is in the form of a diaphragm drive in the present case. The switching drive 15 comprises a switching drive housing 16 which is provided with an air port 17 and which is subdivided in the interior into two chambers 19 and 20 via a diaphragm 18, wherein the diaphragm 18 is held in an initial position by restoring springs 21, which are arranged in the chamber 19 without the compressed-air port 17. Fastened to the diaphragm 18 is a spindle 22 which, with the aid of a spindle coupling 23, is connected to the valve spindle 24 of the control device 12 and seals off valve seats 25*a* and 25*b*, positioned opposite one another, according to the switching position. In the initial position, the fresh steam is released to the control line 13 via the control line 14 and ultimately acts on the main cone 11 of the quick-closing valve 5, said valve assuming the position "closed". The outlet 26 to the atmosphere or leakage steam line is closed. If the chamber 20 is subjected to compressed air proceeding from the initial position illustrated in FIG. 2, then the valve spindle 24 is moved away from the valve seat 25*a* toward the valve seat 25*b* via the diaphragm 18 with the spindle 22 until the latter valve seat is sealed tight, the control line 14 closes and, in this way, the outlet 26 as well as a control channel 27 of the quick-closing valve 5 is opened to the atmosphere. As a consequence, also a cylinder chamber 28 becomes pressureless via a throttle 29 and a gap surface 30 and a cylinder chamber 31 becomes pressureless via a bore 32 and the main cone 11 of the quick-closing valve 5. The pressure of the fresh steam holds the pilot-control cone 10, via the inflow bores 33, and the main cone 11 in an open position, in each case counter to the force of a spring 34, wherein both cones, in the rear end position, block the passage of the fresh steam into the cylinder chamber 28 or into the control line 13 in a leakage-free manner. Correspondingly, it is possible for the fresh steam to flow via an inlet screen 35 to the regulating valves 6 connected downstream.

The triggering of the quick-closing valve 5 is realized by the relief of the air pressure at the control device. Correspondingly, the chamber 20 of the switching drive 15 is not subjected to compressed air. The control line 13 is closed to the atmosphere in that the valve spindle 24 is pushed onto the valve seat 25*b* by the spring force of the restoring springs 21 via the spindle 22 with the spindle coupling 23 and subjected to the fresh steam pressure. The cylinder chamber 28 is, via the control line 13, the control channel 27 and the inflow bore 33, also subjected to pressure. The pilot-control cone 10 thereby acquires a pressure force counter to the opening force, wherein the steam forces at the pilot-control cone 10 are equalized and this goes into the closed position due to the force of the spring 34. Correspondingly, the cylinder chamber 28 is subjected to the pressure of the fresh steam via the inflow bores 33, an open control channel 36 and bores 37 and via the adjustable throttle 29 and the gap surface 30. The main cone 11 thereby acquires a pressure force which is directed opposite to the opening force. The pressure forces at the main cone 11 are equalized, as a result of which said cone is closed, or pushed against the associated valve seat, by way of the force of the spring 34.

FIGS. 3 to 8 shows different functional positions of a pneumatic safety block 38 which is connected to the turbine protection unit 3 and is designed for activating the pneumatic switching drive 15 of the control device 12 of the quick-closing valve 5. The safety block 38 comprises three structurally identical, electromagnetically actuated 5/2 directional valves V1, V2 and V3 with spring restoring means, which are arranged in series in a 2-of-3 circuit, two pressure ports P1 and P2, a test port P3, and a pressure outlet E1 which is connected to the compressed-air port 17 of the switching drive 15 of the quick-closing valve 5.

Figure 3:
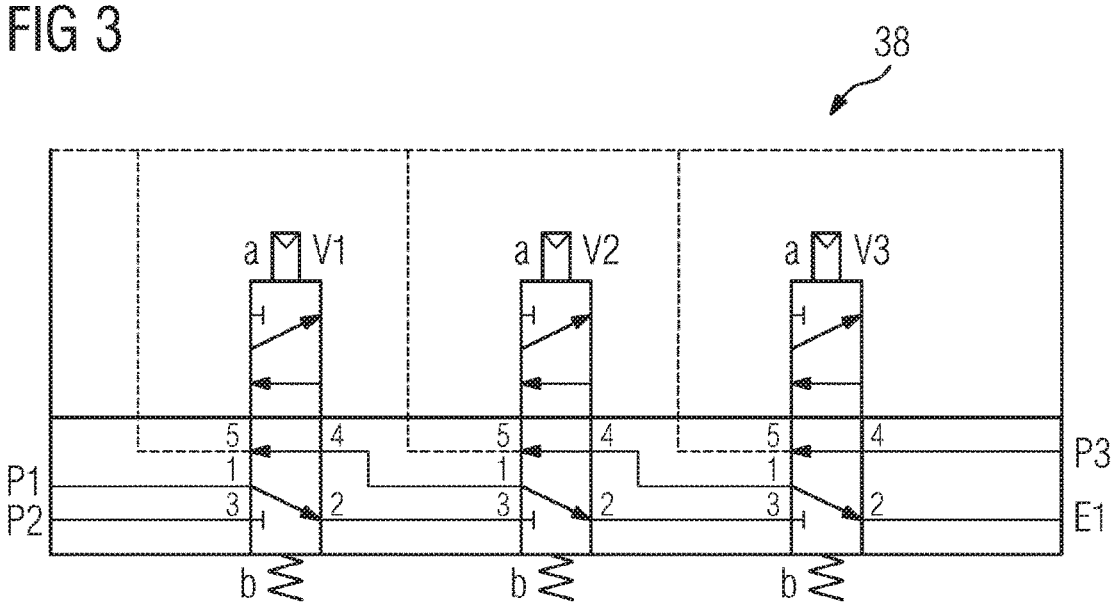
FIG. 3 is a schematic view, which shows a pneumatic safety block in different operating positions, wherein none of the directional valves V1, V2 and V3 is actuated.

In the initial position illustrated in FIG. 3, none of the directional valves V1, V2 and V3 is actuated, and so a pressure prevails neither at the pressure outlet E1 nor at the test port P3. Correspondingly, the main cone 11 of the quick-closing valve 5 is also situated in its closed position.

Figure 4:
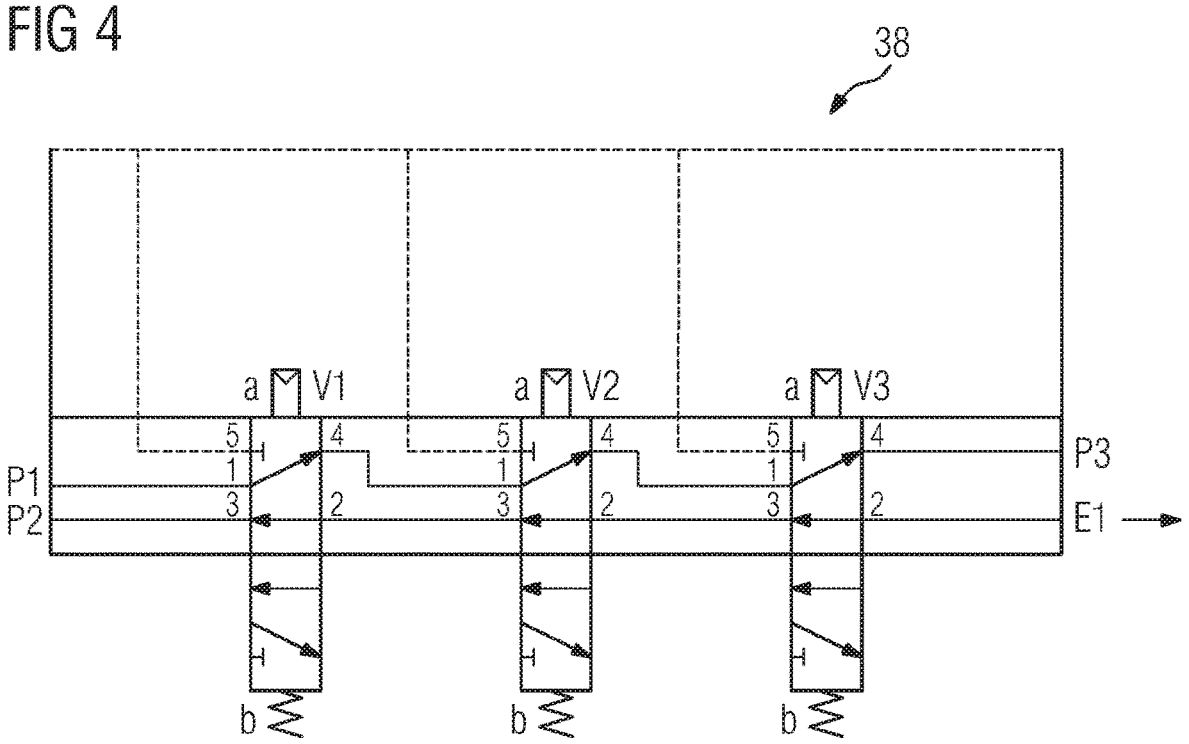
FIG. 4 is a schematic view illustrating when all three directional valves V1, V2 and V3 are actuated.
Figure 5:
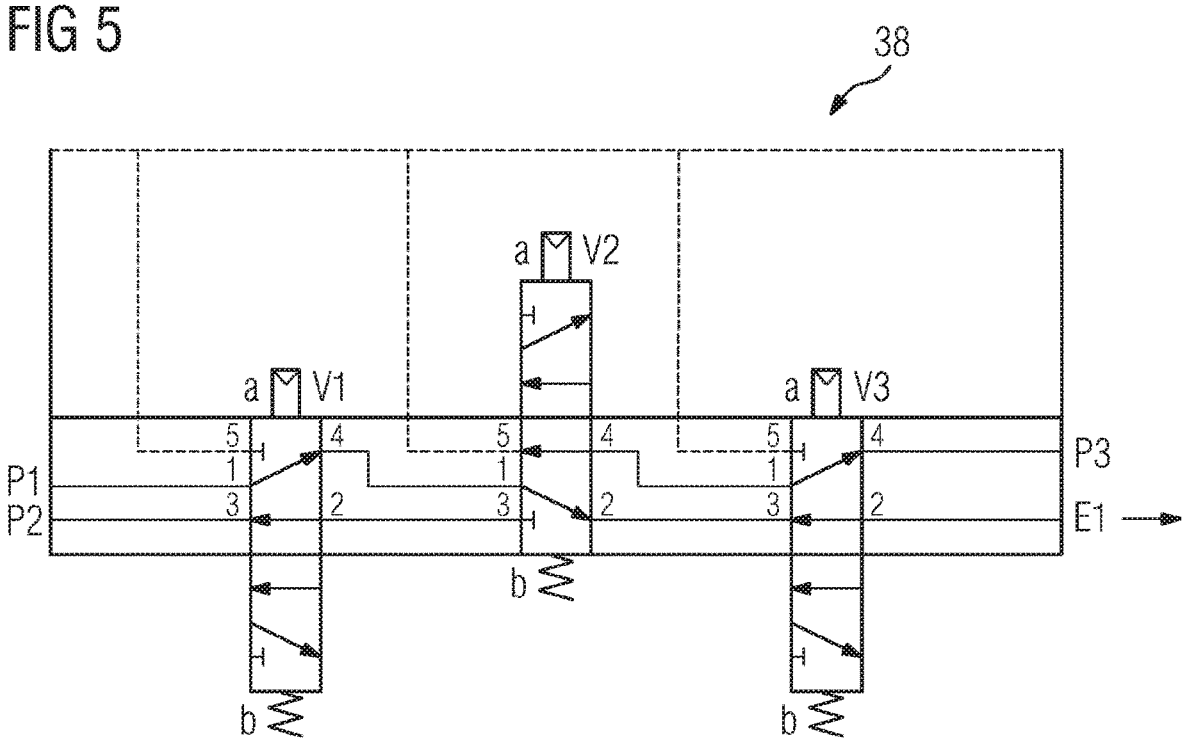
FIG. 5 is a schematic view illustrating another operating position.

If all three directional valves V1, V2 and V3 are actuated, as is shown in FIG. 4, then a pressure prevails both at the test port P3 and at the pressure outlet E1. Correspondingly, the quick-closing valve 5 is transferred into its open position, with the result that the fresh steam is able to flow in the direction of the regulating valves 6.

If two of the three directional valves V1, V2 and V3 are actuated, then a pressure prevails at pressure outlet E1, wherein in each case one of the channels to the directional valves V1, V2 and V3 is pressureless and connected to the test port P3.

Figure 6:
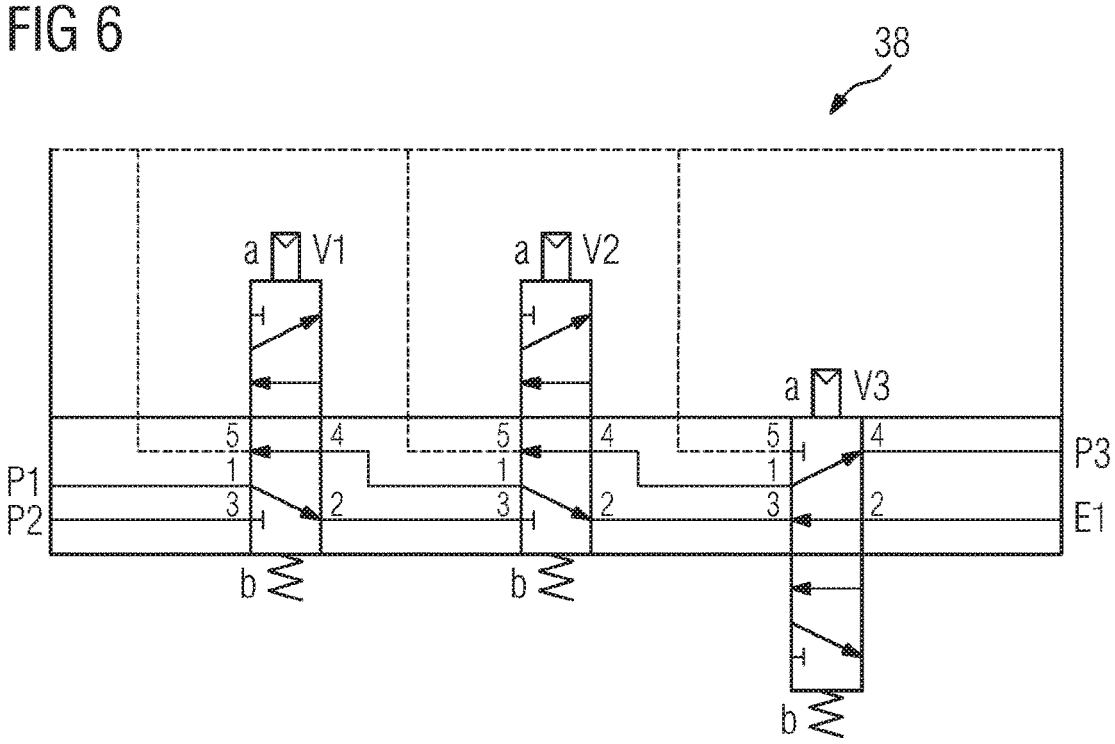
FIG. 6 shows a schematic view of a non-actuated position.
Figure 7:
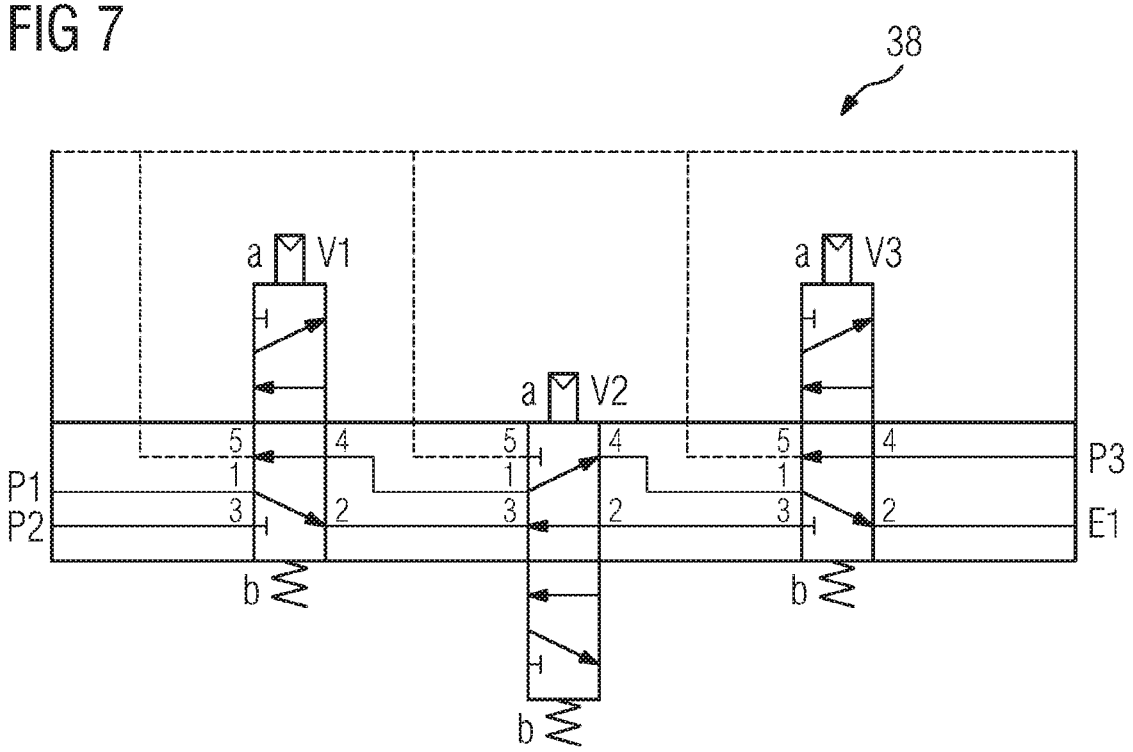
FIG. 7 shows another schematic view of a non-actuated position.
Figure 8:
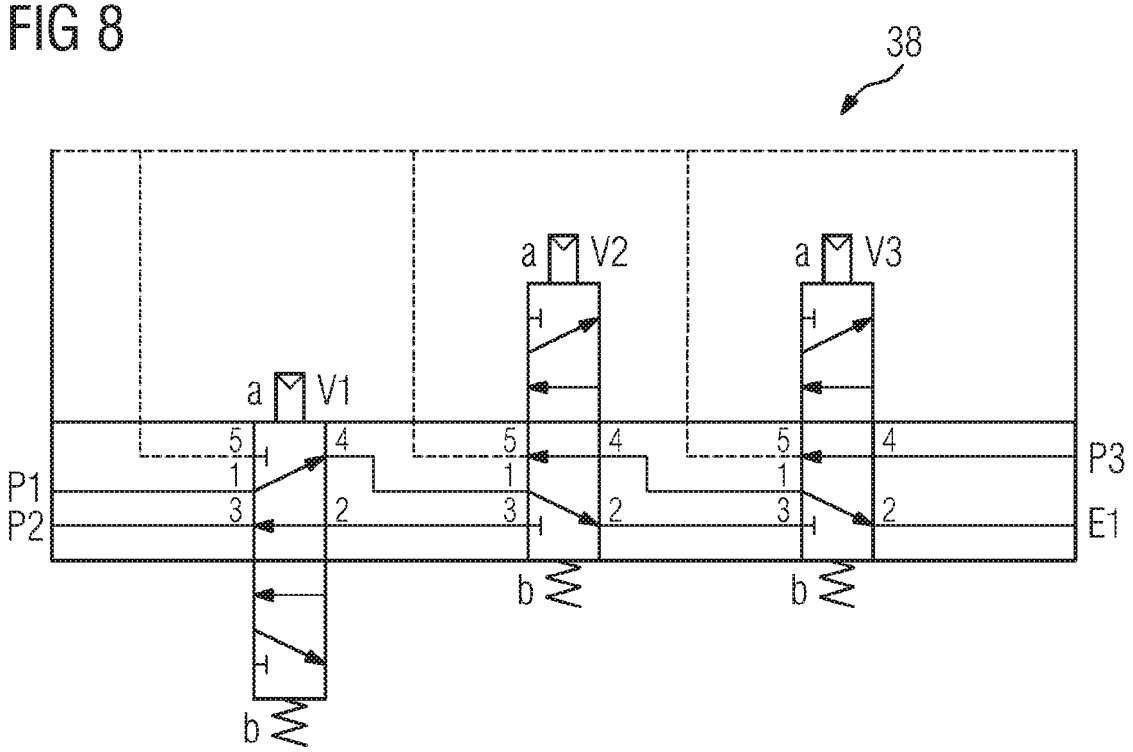
FIG. 8 shows another schematic view of a non-actuated position.

In order to achieve a closed position of the quick-closing valve 5, it is necessary for at least two of the three directional valves V1, V2 and V3 to be transferred into the non-actuated position, as is illustrated in FIGS. 6, 7 and 8. In principle, with reference to FIGS. 4 to 8, an actuation of the switching drive 15 or of the quick-closing valve 5 is therefore also possible should one of the directional valves V1, V2, V3 be defective, and so downtimes of the turbine 1 due to defective directional valves can be avoided.

The regulating valves 6 are in the present case double-seat regulating valves with in each case two main cones 39 which are connected to one another and which are assigned corresponding valve seats formed on the housing 8. The main cones 39 of the regulating valve 6 arranged on the far right in FIG. 1 are coupled to a spindle of an electrical actuating drive 41 which is in turn connected to the turbine regulation unit 2 and the turbine protection unit 3, with the result that the main cones 39 are able to be moved selectively into a closed position or into a completely or partially open position with the actuation of the actuating drive. The main cones 39 of the other two regulating valves 6 are in turn transferred into their completely or partially open position via the regulating valve connected to the actuating drive 41. In each case restoring springs 42 are provided for moving the main cones 39 into their closed position. Instead of the electrical actuating drive 41, it is in principle also possible for a hydraulic actuating drive with autonomous oil supply to be provided, which is advantageously operated with a liquid of low flammability, even though this is not shown in the present case. Such hydraulic actuating drives with autonomous oil supply are known in the prior art, and for this reason a more detailed discussion is dispensed with at this point.

In the case of the above-described structure of the high-pressure valve group 4, the quick-closing valve 5 is controlled via the turbine protection unit 3 and the pneumatic safety block 38, and the regulating valves 6 are controlled via the turbine regulation unit 2 and the turbine protection unit. Correspondingly, it is possible for a central control- and regulation-oil system to be dispensed with, this being associated with a large cost reduction and with a minimization of the risk of fire, presented by such a control- and regulation-oil system, in the event of leakage. This also applies if a hydraulic actuating drive with autonomous oil supply is used instead of the electrical actuating drive 41.

Figure 9:
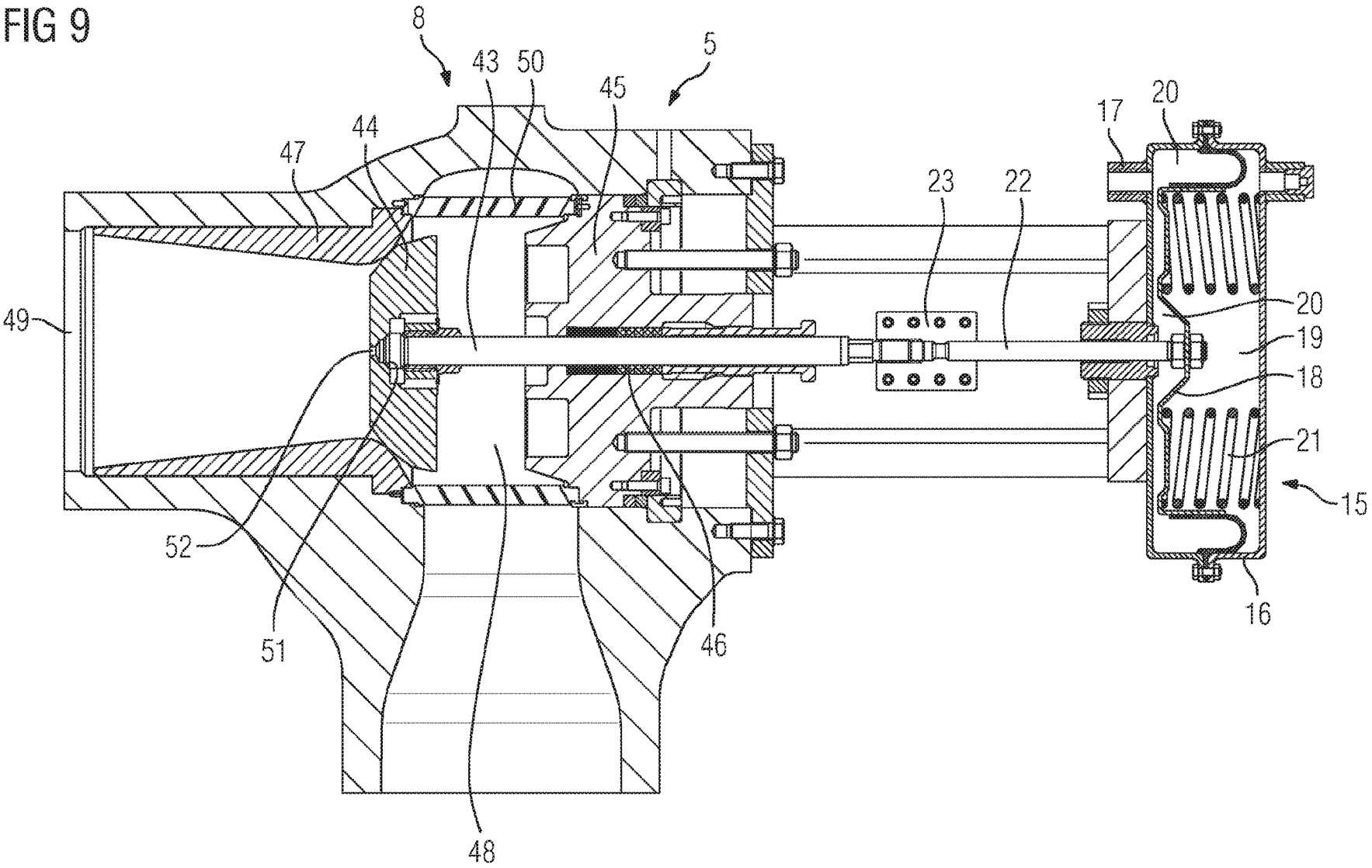
FIG. 9 is a schematic view, which shows a further quick-closing valve according to an embodiment of the invention, said valve not being illustrated in FIG. 1.

Even though only the high-pressure valve group 4 of the turbine 1 is illustrated in FIG. 1, embodiments of the present invention is not limited to such a high-pressure valve group. Rather, according to the invention, all the switching and actuating drives of quick-closing and regulating valves of the turbine 1, or at least all the switching and actuating drives of quick-closing and regulating valves at positions with high risk potential, such as in particular at the hot front end of the turbine 1, are configured in the above-described way. Furthermore, it should be clear that this also applies to quick-closing and regulating valves which have a different structure than the valves 5 and 6 shown. Even though a medium-actuated quick-closing valve is illustrated in FIG. 1 as an example for a quick-closing valve, it should also be pointed out that directly actuated quick-closing valves may also be equipped with a pneumatic switching drive of the above-described type. In such directly actuated quick-closing valves, the pneumatic switching drive then acts directly on the spindle of the quick-closing valve. Depending on the type of quick-closing valve, the direction of action of the switching drive in the pressureless state may be with the spindle retracted or extended. FIG. 9 shows a structural design of a quick-closing valve 5 with an extended spindle, which in the present case is a single-seat, quick-closing pilot-stroke valve.

Situated in the housing 8 is a pilot-stroke spindle 43 which forms, together with the main cone 44, a unit referred to as a pilot-stroke valve, which is moved into the position "open" or "closed" by way of a pneumatic switching drive 15. The pilot-stroke spindle 43 is guided in the cover 45 and is sealed off with respect to the atmosphere via a packing 46 in accordance with the known prior art. The switching drive 15 is, as already described, a diaphragm drive and consists of a switching drive housing 16 which is provided with an air port 17 and which is subdivided in the interior into two chambers 19 and 20 via a diaphragm 18, wherein the diaphragm 18 is held in an initial position by the restoring springs 21, which are arranged in the chamber 19 without the compressed-air port 17. Fastened to the diaphragm 18, which is subjected to spring action, is a spindle 22 which, with the aid of a spindle coupling 23, is connected to the pilot-stroke spindle 43 and pushes the main cone 44 into a valve seat 47 and seals off in the position "closed". If the quick-closing valve 5 is now subjected to fresh steam pressure in a chamber 48, then this position "valve closed" continues to be maintained.

If the chamber 20 is subjected to compressed air proceeding from the initial position, then the pilot-stroke spindle 43 is moved from the valve seat 51 in the interior of the main cone 44 via the diaphragm 18 with the spindle 22, and the steam inflow is released via a bore 52 of the main cone 44 to a chamber 49 upstream of the closed regulating valves. After this chamber 49 has filled with steam and has reached approximately 75-80% of the fresh steam pressure, the main cone 44 lifts off the valve seat 47 and moves toward the cover 45 until it has reached the end position "valve open". The steam flow can now flow via a steam screen 50 to the regulating valves connected downstream.

The triggering of the quick-closing valve 5 is realized by the relief of the air pressure at the switching drive 15. Correspondingly, the air inflow into the chamber 20 of the switching drive 15 is interrupted and a connection to the atmosphere is realized. This results in the steam force in the opening direction at the pilot-stroke spindle 43 with the main cone 44 being overcome by the spring force of the restoring springs 21 via the spindle 22 with the spindle coupling 23, and in movement in the closing direction until the valve seat 47 is steam-tight again. Thus, the initial position "valve closed" is reached again and the pilot-stroke valve is subjected to fresh steam pressure.

Similar to the case of the hydraulic drive, the partial-stroke test of the quick-closing valve 5 may be realized by opening an additional magnet valve in the feed air line. In the chamber 20, the pressure is slowly lowered until the pilot-stroke valve moves, under the spring force of the restoring springs 21, from the end position in the direction "closed". A change of position of 15-20% is sufficient for the partial-stroke test.

Furthermore, embodiments of the present invention proposes retrofitting an existing turbine, which has a turbine protection unit, a turbine regulation unit, a hydraulic safety block, quick-closing valves and regulating valves, wherein the quick-closing valves are able to be actuated via assigned hydraulic switching drives, in such a way that the hydraulic switching drives of the quick-closing valves are at least partially, preferably however completely, replaced by pneumatic switching drives, and a pneumatic safety block is provided, which at least partially replaces the functions of the hydraulic safety block. Moreover, hydraulic actuating drives of regulating valves of the existing turbine are preferably replaced by electrical actuating drives and/or by hydraulic actuating drives with autonomous oil supply, with the result that the entire control- and regulation-oil system of the existing turbine can be dispensed with.

Even though the invention has been more specifically illustrated and described in detail on the basis of the preferred exemplary embodiment, the invention is not limited to the disclosed examples, and other variations may be derived herefrom by a person skilled in the art without departing from the scope of protection of the invention.

For the sake of clarity, it is to be understood that the use of "a" or "an" throughout this application does not exclude a plurality, and "comprising" does not exclude other steps or elements.

The invention claimed is:

1. A turbine having at least one safety block, quick-closing valves and regulating valves, wherein the quick-closing valves and the regulating valves are able to be actuated via assigned switching and actuating drives, wherein the at least one safety block is a pneumatic safety block, and in that at least one of the switching drives for directly or indirectly actuating at least one of the quick-closing valves is a pneumatic switching drive.

2. The turbine as claimed in claim 1, wherein all the switching drives for actuating the quick-closing valves are pneumatic switching drives.

3. The turbine as claimed in claim 1, wherein the at least one pneumatic safety block is configured to control the pneumatic switching drive or the pneumatic switching drives.

4. The turbine as claimed in claim 1, wherein the pneumatic safety block has a plurality of 5/2 directional valves connected in series.

5. The turbine as claimed in claim 4, wherein the plurality of 5/2 directional valves connected in series is three 5/2 directional valves connected in series in a 2-of-3 circuit.

6. The turbine as claimed in claim 1, wherein, electrical actuating drives and/or hydraulic actuating drives with autonomous oil supply, are provided for actuating the regulating valves.

7. The turbine as claimed in claim 6, wherein, the electrical actuating drives and/or the hydraulic actuating drives with the autonomous oil supply, are operated with a liquid of low flammability, are provided for actuating the regulating valves.

8. A method for retrofitting an existing turbine having a hydraulic safety block, quick-closing valves and regulating valves, wherein the quick-closing valves are able to be actuated directly or indirectly via assigned hydraulic switching drives, wherein at least one hydraulic switching drive of a quick-closing valve is replaced by a pneumatic switching drive, and in that a pneumatic safety block which at least partially replaces the functions of the hydraulic safety block is provided.

9. The method as claimed in claim 8, wherein all the hydraulic switching drives are replaced by pneumatic switching drives.

10. The method as claimed in claim 8,
wherein
at least one pneumatic switching drive is controlled via the pneumatic safety block.

11. The method as claimed in claim 8,
wherein
at least one hydraulic actuating drive is replaced by an electrical actuating drive.

12. The method as claimed in claim 8,
wherein
at least one hydraulic actuating drive, which is connected to a central control- and regulation-oil system of the turbine, is replaced by a hydraulic actuating drive with autonomous oil supply.

* * * * *